US005818465A

United States Patent [19]

Abrash

[11] Patent Number: 5,818,465

[45] Date of Patent: Oct. 6, 1998

[54] FAST DISPLAY OF IMAGES HAVING A SMALL NUMBER OF COLORS WITH A VGA-TYPE ADAPTER

[75] Inventor: Michael Abrash, Redmond, Wash.

[73] Assignee: Microsoft Corporation, Redmond, Wash.

[21] Appl. No.: 661,812

[22] Filed: Jun. 11, 1996

Related U.S. Application Data

[63] Continuation of Ser. No. 125,541, Sep. 22, 1993, abandoned.

[51] Int. Cl.[6] ..... G09G 5/06

[52] U.S. Cl. ..... 345/510; 345/132; 345/153; 345/114

[58] Field of Search ..... 345/186, 510, 345/153, 155, 132, 114, 118, 199, 501, 502

[56] References Cited

U.S. PATENT DOCUMENTS

| | | | |
|---|---|---|---|
| Re. 32,749 | 9/1988 | Ohura | 345/114 |
| 4,467,322 | 8/1984 | Bell et al. | 345/114 |
| 4,727,414 | 2/1988 | Rarf et al. | 348/793 |
| 4,811,007 | 3/1989 | Schreiber | 345/187 |
| 4,982,345 | 1/1991 | Callahan et al. | 345/118 |
| 5,036,216 | 7/1991 | Hohmann et al. | 331/25 |
| 5,065,144 | 11/1991 | Edelson et al. | 345/186 |
| 5,095,301 | 3/1992 | Guttag et al. . | |
| 5,189,401 | 2/1993 | Kugler, Jr. et al. | 345/186 |
| 5,235,677 | 8/1993 | Needle et al. | 345/186 |
| 5,276,458 | 1/1994 | Sawdon | 345/132 |
| 5,300,946 | 4/1994 | Patrick | 345/153 |
| 5,455,600 | 10/1995 | Friedman et al. | 345/153 |

FOREIGN PATENT DOCUMENTS

| | | |
|---|---|---|
| 0 253 352 | 1/1988 | European Pat. Off. . |
| 4060586 | 2/1992 | Japan . |

OTHER PUBLICATIONS

"Use of EGA SR Register For Improved Performance and Appearance of APA Character Displaying For Selected Color Combinations," *IBM Technical Disclosure Bulletin 31*(3): 364–366, 1988.

Ferraro, Richard F., *Programmer's Guide to the EGA and VGA Cards*, 2d ed., Addison–Wesley Publishing Company, Inc., Reading, MA, 1990, pp. 8–19, 192–195, 228–237.

Michael Abrash, *Programmer's Journal 6.1*, "Write Mode 3 of the VGA," 1988, pp. 16–20,22,24,26.

Michael Abrash, *Programmer's Journal 7.1*, "Higher 256–Color Resolution on the VGA," 1989, pp. 18–20,22, 24–25,27–30.

Michael Abrash, *Programmer's Journal*, "VGA color cycling," 1991, pp. 20–24,26,28–30.

Michael Abrash, *Programmer's Journal*, "More VGA color complexity–VGA color paging," 1990, pp. 20–29.

Michael Abrash, *Dr. Dobb's Journal*, "Color Modeling in 256–color Mode," 1992, pp. 149–150,152,154,166–168.

Michael Abrash, *Dr. Dobb's Journal*, "256–Color VGA Animation," 1991, pp. 127–128,130,143,145–147.

Michael Abrash, *Dr. Dobb's Journal*, "More Undocumented 256–Color VGA Magic," 1991, pp. 165–166,168–169,181–183.

Michael Abrash, *Programmer's Journal 6.2*, "Yet Another VGA Write Mode," 1988, pp. 26–30,32,34,36.

*Primary Examiner*—Lun-Yi Lao
*Attorney, Agent, or Firm*—Christensen O'Connor Johnson & Kindness PLLC

[57] ABSTRACT

An approach to outputting 256-color pixel data more quickly than conventional systems is provided. In this approach, a word of data encoding a color bit map for up to eight pixels may be stored in a system buffer and then written to a video adapter. The video adapter is configured such that color codes for multiple pixels may be simultaneously written into the planes of the display memory of the adapter. As a result, 256-color pixel data may be more quickly drawn on a video display than in conventional systems.

15 Claims, 5 Drawing Sheets

FAST DISPLAY OF IMAGES HAVING A SMALL NUMBER OF COLORS WITH A VGA-TYPE ADAPTER

CROSS-REFERENCE TO RELATED APPLICATION

This application is a continuation of U.S. patent application Ser. No. 08/125,541, filed Sep. 22, 1993, now abandoned.

TECHNICAL FIELD

The present invention relates generally to data processing systems and, more particularly, to video adapters.

BACKGROUND OF THE INVENTION

The original video graphics array (VGA) type adapters were designed primarily to operate in a 16-color mode wherein each pixel could assume one of sixteen different colors. The original VGA architecture also included one 256-color mode wherein each pixel could assume any one of 256 available colors. One difficulty with the 256-color mode was that it was very slow relative to the 16-color mode. The original VGA architecture has been extended to Super VGAs (SVGAs). The original 256-color mode of VGAs has been extended in SVGAs to higher resolutions. In addition, the SVGAs allow one word of data (i.e., two bytes) to be simultaneously written to the display memory of an adapter rather than the one byte of data maximum permitted in the original VGA architecture. However, due to the higher resolution, the 256-color modes of the SVGA operate slower than the 16-color modes.

SUMMARY OF THE INVENTION

The difficulties of the conventional systems are overcome by the present invention. In accordance with a first aspect of the present invention, a method is practiced in a system having a video display, a central processing unit (CPU) and a VGA-type adapter. The VGA-type adapter includes a display memory. In this method, a bit map for multiple pixels are gathered into a system buffer. The bit map specifies the colors of the pixels. At least a portion of the bit map is forwarded under CPU control from the system buffer to the adapter. 256-color codes for the colors that the pixels specified by the bit map are written simultaneously to the display memory to display the pixels on the video display.

In accordance with another aspect of the present invention, a method is practiced in a system having a video display, a central processing unit, and a VGA-type adapter. The VGA-type adapter includes a bit mask register, a display memory that is divided into multiple planes, and a latch for each plane. A bit map for multiple pixels to be displayed on the video display are gathered in a system buffer. The bit map specifies whether each pixel is to assume a background color or a foreground color. The adapter is configured by placing the adapter in write mode 2, disabling chain 4 mode, and enabling write access to all planes of the display memory. The latches are loaded with a 256-color code for the background color. A result of an exclusive OR of the 256-color code for the background color with a 256-color code for the foreground color is loaded into the bit mask register. The font data is forwarded from the system buffer to the adapter so that the 256-color codes for the color specified by the bit map for the pixels are written to the display memory to display the pixels on the video display.

In accordance with a further aspect of the present invention, a word of data is forwarded to a VGA-type video adapter. The word of data includes a bit map for multiple pixels that specifies a color for each of the multiple pixels. 256-color codes for the colors specified by the forwarded bit map for the pixels are simultaneously written to the display memory to display the pixels on the video display.

DETAILED DESCRIPTION OF THE INVENTION

The preferred embodiment of the present invention provides a much quicker means for outputting pixel color data in 256-color mode on SVGAs and VGAs than conventional systems. Hereinafter, the term "VGA-type adapter" will be used to refer to a VGA or an SVGA adapter. The improved speed is obtained by operating the VGA-type adapter in a unique 256-color mode. A system buffer is provided to hold bit map data before it is output to the VGA-type adapter. The system buffer gathers bit map data so that up to eight pixels of data may be accessed at a time and allows the processing of data in large, regular size chunks with alignment issues resolved.

Figure 1:
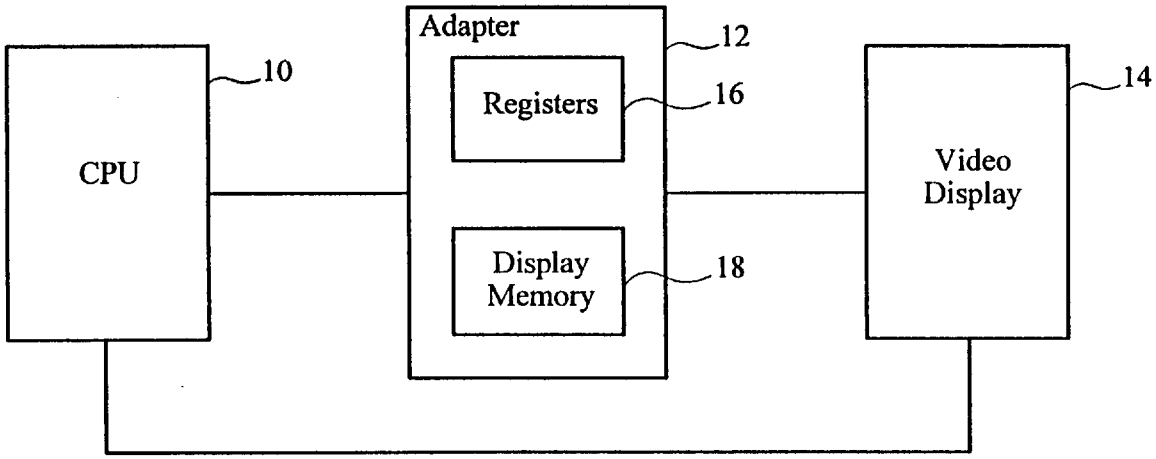
FIG. 1 is a block diagram of a system for practicing a preferred embodiment of the present invention.

FIG. 1 is a block diagram of a system that is suitable for practicing the preferred embodiment of the present invention. The system includes a central processing unit (CPU) 10 that outputs color data (i.e., bit maps) for an image to a video adapter 12. The CPU 10 may be part of a larger computer system, such as a microcomputer. The adapter 12 converts the data received from the CPU 10 into electrical signals that are forwarded to the video display 14 to generate the desired image. The adapter 12 includes a number of registers 16 and a display memory 18, which will be described in more detail below. Image data is displayed on the video display 14 by writing color codes for the character data into the display memory 18. The registers 16 are used to configure and control the operation of the adapter 12.

Figure 2:
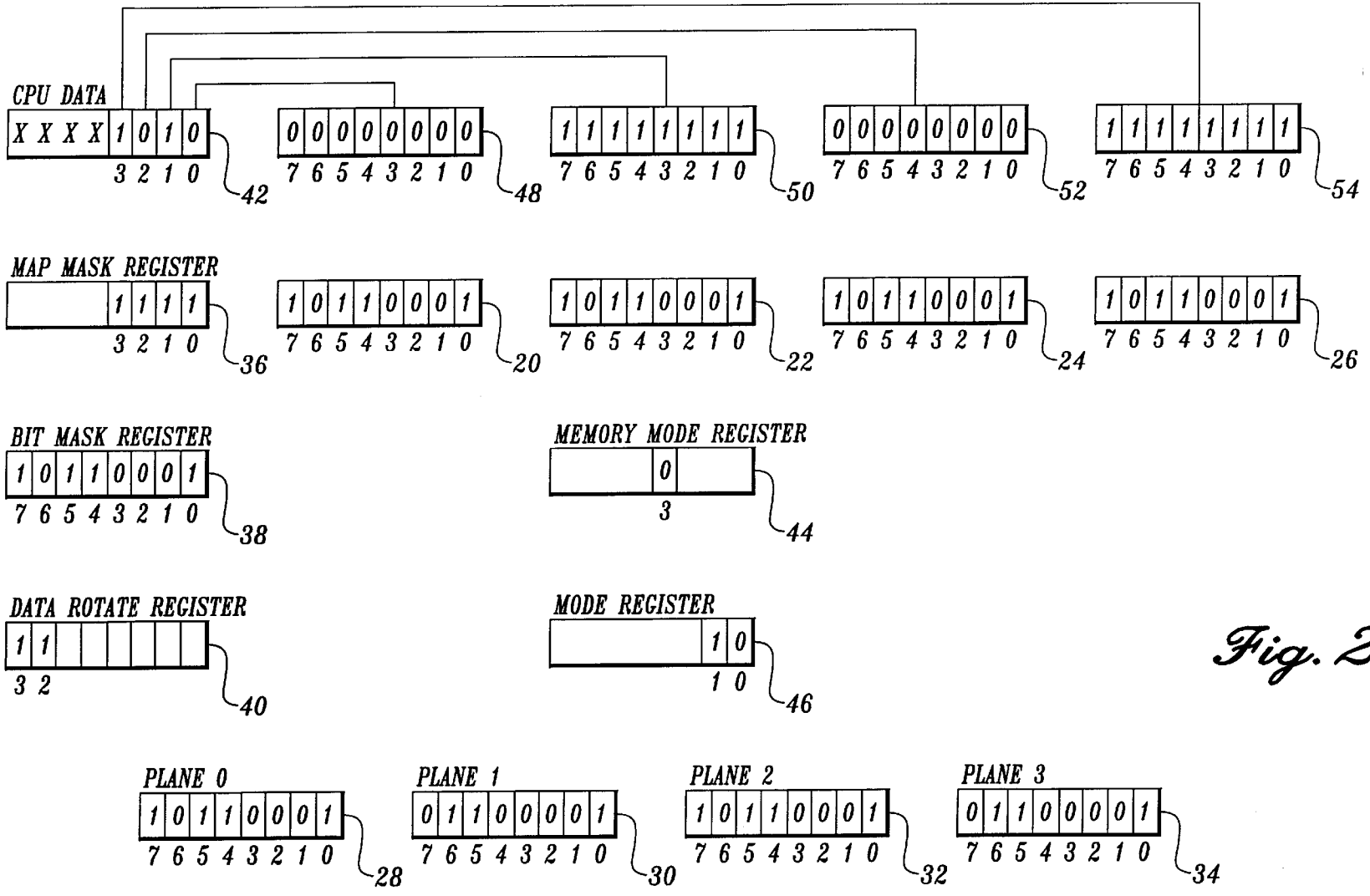
FIG. 2 is a block diagram illustrating in more detail registers and a display memory of the adapter shown in FIG. 1.

A number of the registers 16 are shown in FIG. 2, along with a portion of the display memory 18. The display memory 18 is configured into four planes: plane 0, plane 1, plane 2 and plane 3. Generally, the four planes are provided in a display memory of a video adapter in order to hold respective color components of a single pixel of an image. In particular, each plane is associated with a red component, a green component, a blue component, or an intensity component for the color of a single pixel. In the preferred embodiment of the present invention, however, the color data for pixels is not spread across the planes but rather is contained on a single plane. A single byte (i.e., 8 bits) 28, 30, 32 and 34 is shown in FIG. 2 for each of the planes of the display memory 18. A separate latch 20, 22, 24 and 26 is provided for each of the planes of display memory. Each of the latches 20, 22, 24 and 26 can hold up to a byte of data. The latches 20, 22, 24 and 26 are used to latch data into or out of the planes of the display memory 18.

Among the registers 16 of the video adapter 12 shown in FIG. 2 is a map mask register 36. The map mask register 36 selects which bit planes are affected by a write operation. Any of the selected bit planes are modified according to a function select field of the data rotate register 40 (which will be described in more detail below). In particular, bit 0 of the map mask register is associated with display plane 0; bit 1 is associated with display plane 1; bit 2 is associated with display plane; and bit 3 is associated with display plane 3. If the value held in one of these bits is a "1", the display plane is enabled. In contrast, if the value held in one of these bits is a "0", the display plane is not enabled.

FIG. 2 also shows a bit mask register 38. The bit mask register 38 holds bits which select the bit positions within the four bit planes that are affected by a write operation. Each bit in the bit mask register 38 corresponds to one of the bits within a byte of the planes of the display memory 18 (FIG. 1). Any bit in the bit mask register 38 that is set to "1" means that data at the corresponding bit position in the CPU data 42 is written into the bit position of the display memory, subject to a logical operation with the latch data. A "0" value in a bit position of the bit mask register 38 implies that the latch data at the corresponding bit position is to be written to the bit position in display memory.

FIG. 2 additionally shows a data rotate register 40. The data rotate register 40 serves multiple roles, including the specification of whether bits of input data should be shifted 0–7 bits to the right. However, for the preferred embodiment of the present invention, bits 2 and 3 of the data rotate register are of interest. Bits 2 and 3 of the data rotate register form the function select field and determine the logical function that is performed with CPU data 42 (provided by CPU 10) and data held in the latches 20, 22, 24 and 26. Four logical functions are available, and the values held in bits 2 and 3 of the data rotate register select among these four logical functions.

A memory mode register 44 is also shown in FIG. 2. The memory mode register 44 contains several fields which control the way in which display memory 18 (FIG. 1) functions. Bit 3 of the memory mode register 44 controls the manner in which the display planes are accessed. Specifically, bit 3 of the memory mode register 44 determines whether chain 4 mode is turned "on" or "off". When chain 4 mode is "on", the four display memory display planes (i.e., 0, 1, 2 and 3) are chained together, and only one bit plane can be accessed at a time. In contrast, when chain 4 mode is "off", any combination of the four display planes may be accessed at a time.

A final register shown in FIG. 2 is the mode register 46. The mode register 46 includes a number of fields that control the read and write modes of the adapter 12. Bits 0 and 1 control the write mode of the adapter 12. Four write modes are available in VGA-type adapters. The values in bits 0 and 1 of the mode register 46 select one of these write modes.

Figure 3:
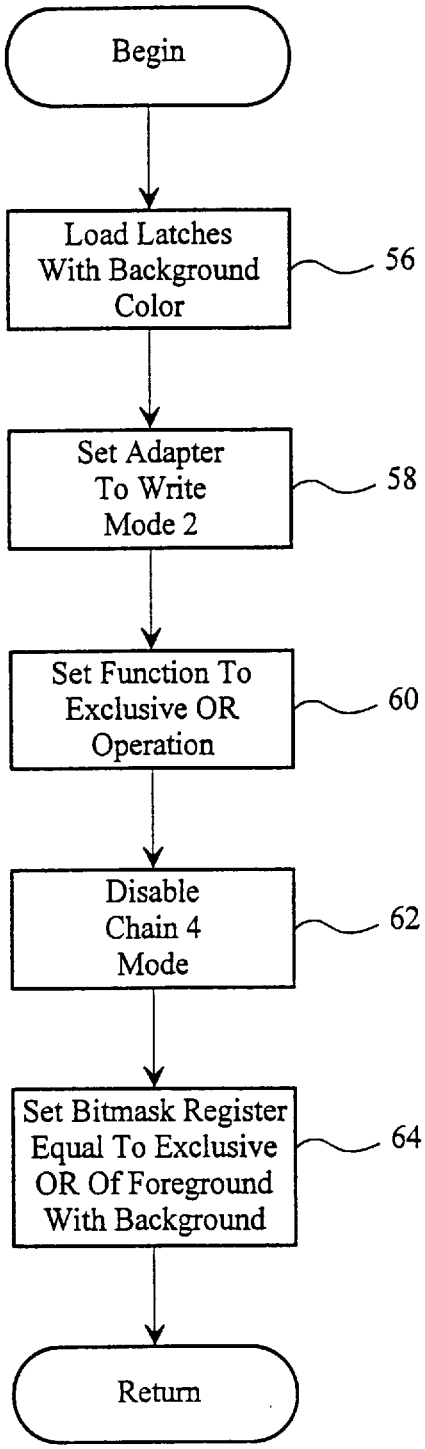
FIG. 3 is a flowchart of the steps performed to display pixels on a video display in the preferred embodiment of the present invention.

The above-described registers in the adapter 12 are utilized to control the adapter so that the display memory 18 may be quickly accessed in a 256-color mode. FIG. 3 is a flowchart of the steps performed to quickly write pixel color data for characters to the display memory 18. Initially, a bit map is provided in the lower 4 bits of the CPU data 42. The ordering of bits must be reversed from the conventional ordering. In FIG. 2, this reversing has already been done. Each of the bit positions is associated with a particular pixel. In opaque mode for outputting text, a "0" value in a bit position implies that the associated pixel is to assume a background color, whereas a "1" value in a bit position implies that the associated bit is to assume a foreground color. In contrast, with transparent mode for outputting text, a "1" value in a bit position implies that the associated pixel is to assume a foreground color, but a "0" value in a bit position implies that a pixel is to retain its current color. The example of FIG. 2 supposes that text is to be output in opaque mode. Thus, in the example shown in FIG. 2, two of the pixels are to be output with the background color and two of the pixels are to be output with the foreground color. The background color is encoded by the color code "10110001". The foreground color is encoded by the color code "01100001".

The latches 20, 22, 24 and 26 are loaded with the background color code "10110000" (step 56 in FIG. 3). The adapter 12 (FIG. 1) is then set to write mode 2 (step 58 in FIG. 3). The adapter 12 is set into write mode 2 by putting a "1" in bit position 1 and a "0" in bit position 0 of the mode register 46 (FIG. 2). In write mode 2, each of the four lowermost bits (i.e., bit positions 0–3) of the CPU data 42 are expanded into an entire byte. Thus, bit position 0 is expanded into a byte 48 of all zeros, bit position 1 is expanded into a byte 50 of all ones, bit position 2 is expanded into a byte 52 of all zeros, and bit position 3 is expanded into a byte 54 of all ones.

The function select bits (i.e., bits 2 and 3) of the data rotate register 40 (FIG. 2) are then set to select an exclusive OR operation (step 60 in FIG. 3). Specifically, bits 2 and 3 of the data rotate register 40 are set to have values of "1" so that the exclusive OR operation is selected as the function. Hence, for any bits in the bit mask register 38 that have a value of "1", the corresponding bit in the expanded bytes 48, 50, 52 and 54 of CPU data are exclusively ORed with the corresponding bit in the latches 20, 22, 24 and 26.

Chain 4 mode is disabled (step 62 in FIG. 3) by placing a "0" in bit position 3 of the memory mode register 44. As discussed above, when chain 4 mode is disabled, any combination of the four display planes may be accessed simultaneously.

Lastly, the bit mask register 38 (FIG. 2) is set equal to the exclusive OR of the foreground color code with the background color code. As mentioned above, in FIG. 2, the foreground color code is "01100001", while the background color code is "10110001". Accordingly, the exclusive OR of the foreground color code with the background color code yields a value of "11010000". This value is loaded into the bit mask register 38.

Given the above configuration, it is now helpful to consider what data is written into the display planes of the display memory 18 (FIG. 1) as a result of these steps. The bit mask register 38 (FIG. 2) selects between the data held in the latches 20, 22, 24 and 26 and the data held in the expanded bytes 48, 50, 52 and 54 of CPU data, on a bit-by-bit basis. A bit in one of the latches 20, 22, 24 and 26 is written into the display planes where the corresponding bit position in the bit mask register 38 is a "0", and a bit in the expanded bytes 48, 50, 52 and 54 of CPU data is written into the display planes where the bit in the corresponding bit position in the bit mask register 38 is a "1". Hence, where the bit mask register 38 has a value of "0" in a bit position (which implies that the foreground and background colors have the same bit value for that bit position), the corresponding bits from the latches 20, 22, 24 and 26 are written to the display planes. The bits in the latches are bits of the background color and, as a result, the right value is written into the bit position of the display planes whether the foreground or background color code is desired for the pixel. In the example shown in FIG. 2, the bits at bit positions 0, 1, 2, 3 and 5 all have a value of "0" in the bit mask register 38. Accordingly, bits 0, 1, 2, 3 and 5 of the latches 20, 22, 24 and 26 are written into the associated bit positions of bytes 28, 30, 32 and 34 of display memory.

Bits 4, 6 and 7 of the bit mask register hold a value of "1"; hence, implying that the foreground color code and background color codes differ at these bit positions. The values written into the display planes are an exclusive OR of a value held in the corresponding bit position of the associated latch with the value held in the corresponding bit position of the associated expanded bytes of CPU data. Where the value held in the bit position of the latch differs from the value held in the expanded CPU data, the exclusive OR produces a "1" that is written into a display plane. On the other hand, where the value held in the bit position of the latch equals the value held in the corresponding bit position of the expanded CPU data, a "0" is written into the display plane.

For example, consider latch 20 and expanded byte 48 of CPU data in FIG. 2. The value held in bit 4 of the latch 20 is exclusively ORed with the value held in bit 4 of expanded byte 48 of CPU data. Bit position 4 of the latch 20 has a value of "1", whereas bit position 4 of the expanded byte 48 of CPU data has a value of "0". The exclusive OR operation yields a value of "1" that is written into bit position 4 of the byte 28 of plane 0 of the display memory 18 (FIG. 1). Bit position 6 of the latch 20 holds a value of "0", whereas bit position 6 of the expanded byte 48 of CPU data holds a value of "0". The exclusive OR of these bits yields a "0" that is written into byte 28 of display plane 0.

More generally, when a pixel is to assume the background color, the bits in the background color code held in the latches 20, 22, 24 or 26 that differ from the foreground color code are exclusively ORed with zeros held in the corresponding expanded byte 48, 50, 52 or 54 of the CPU data. An exclusive OR with a "0" yields an identity value equal to the bit value held in the latches 20, 22, 24 and 26. In contrast, the pixels that are to assume the foreground color are exclusively ORed with ones. Exclusively ORing a bit with one inverts the bit value. Accordingly, the bit values that differ between the foreground color code and background color code are identified by the bit mask register 38 with a value of "1", and these bits are set to the foreground color code bit values by exclusively ORing the corresponding bits of the background color code with "1" so as to invert the values to the bit values of the foreground color code. For example, bits 4, 6 and 7 of latch 22 are exclusively ORed with "1" to write the inverse of the values held in the latch 22 into the byte 30 of display plane 1.

Figure 4A:
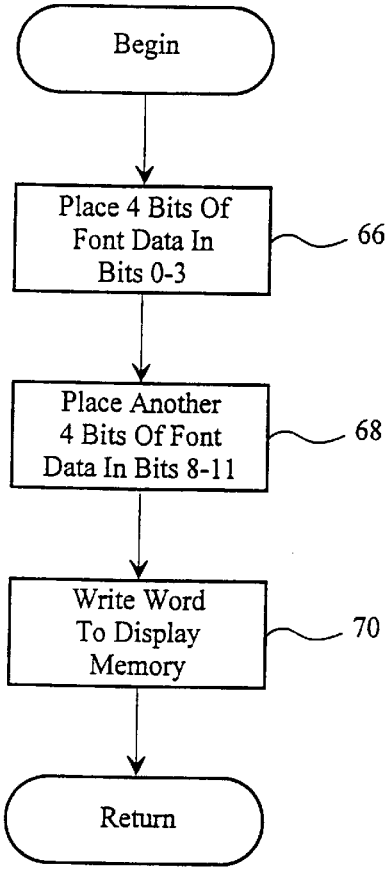
FIG. 4A is a flowchart of the steps performed to simultaneously output the font data for eight pixels to the video adapter in the preferred embodiment of the present invention.
Figure 4B:
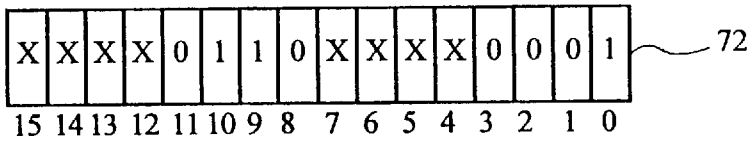
FIG. 4B is an example of the format of a word holding font data that is output to the video adapter in the preferred embodiment of the present invention.

As mentioned above, most SVGAs are capable of processing a word (i.e., two bytes) of data at a time. The above-described approach may be optimized by performing the steps shown in the flowchart of FIG. 4A. This flowchart will be described in conjunction with the illustration shown in FIG. 4B. Four bits of CPU data are written into bits 0 through 3 of word 72 (step 66 in FIG. 4A). In the example shown in FIG. 4B, bits "0001" are written into bit positions 3–0. Another four bits of font data are written into bit positions 8 through 11 (step 68 in FIG. 4A). In the example shown in FIG. 4B, bits "0110" are written into bit positions 11–8. The remaining bit positions have don't care values (designated by "X"). The display word 72 is then written to display memory (step 70 in FIG. 4A). The color code data is then written into display memory and displayed on the video display 14. The four bits held in bits 0–3 and the four bits held in bits 8–11 are processed in a manner like that shown in FIG. 2.

Figure 5:
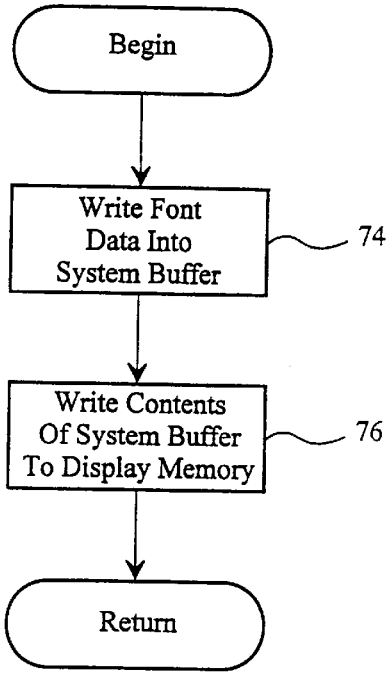
FIG. 5 is a flowchart of the steps performed by the preferred embodiment of the present invention when a system buffer is used.

Another optimization that may be adopted in the preferred embodiment of the present invention is to utilize a system buffer. FIG. 5 shows a flowchart of the steps performed when such a system buffer is used. Specifically, font data is written into a system buffer (step 74 in FIG. 5). The contents of the system buffer are then written out a word at a time to display memory (step 76). The system buffer allows display memory accesses to most often write a maximum amount of data (eight pixels at a time). Furthermore, the data may be organized into large, regular chunks so that when the display memory is accessed, alignment issues and the like are resolved.

Figure 6:
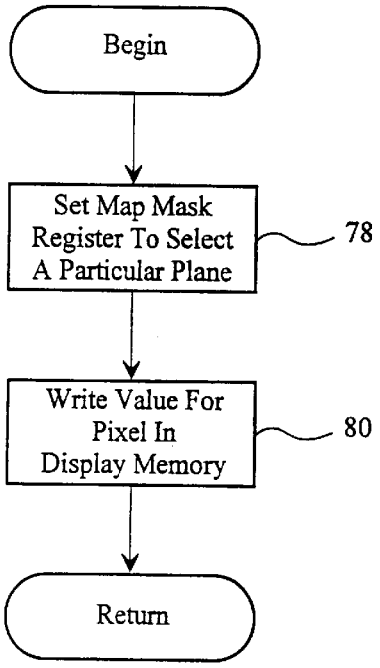
FIG. 6 is a flowchart of the steps performed by the preferred embodiment of the present invention when a single pixel is to be changed.

It should be appreciated that the present invention is not limited to outputting four pixels or eight pixels at a time. Rather, pixels may be output a single pixel at a time. FIG. 6 shows a flowchart of the steps performed to output a single pixel at a time (i.e., to write data for a single pixel into the display memory 18). The map mask register 36 (FIG. 2) is set to select a particular plane (step 78). In other words, one of bits 0–3 of the map mask register 36 is set to a value of "1", whereas the remaining bits are set to a value of 0. The bit having a value of 1 enables the corresponding plane to be written. The value for the pixel is then written into display memory in the appropriate plane (step 80 in FIG. 6).

The above-described technique allows between one and eight pixels to be written at a time into display memory. This is in contrast to conventional systems that are limited to writing one pixel at a time into display memory. As a result, a great increase in speed in outputting 256-color character data to a video display is realized.

While the present invention has been described with reference to a preferred embodiment thereof, those skilled in the art will appreciate that various changes in form and detail may be made without departing from the scope of the present invention as defined in the appended claims.

I claim:

1. A method in a system having a video display, a central processing unit and a VGA-type adapter with a bit mask register, a display memory divided into multiple planes and a latch for each plane, wherein the VGA-type adapter can display at least a total number of 256 different colors and wherein each color displayed by the VGA-type adapter is represented in the display memory by a color code comprising at least 8 bits, said VGA-type adapter having write modes that designate modes for writing data to the planes of the display memory, including write mode 2 in which all of the display planes can be written to, and said VGA-type adapter having modes for accessing the planes of the display memory including chain 4 mode wherein only a single one of the planes of display memory can be accessed at a time, said method comprising the steps of:

gathering in a system buffer a bit map for multiple pixels to be displayed on the video display, wherein the color displayed by each pixel is represented by 1 bit in the bit map said bit map specifying whether each pixel is to assume a background color or a foreground color;

configuring the adapter by:

(i) placing the adapter in the write mode 2;

(ii) disabling the chain 4 mode;

(iii) enabling write access to all planes of the display memory;

loading the latches with an 8-bit color code for the background color;

loading a result of an exclusive OR of the 8-bit color code for the background color with an 8-bit color code for the foreground color into the bit mask register; and forwarding the bit map to the VGA-type adapter from the system buffer so that 8-bit color codes for the colors specified by the bit map for the pixels are written to the display memory to display the pixels on the video display.

2. The method of claim 1 wherein the VGA-type adapter is a Super VGA-type adapter, and wherein color codes comprise at least 16 bits.

3. The method of claim 1, wherein forwarding further comprises:

under CPU control, forwarding a portion of the bit map representing colors for at least two pixels;

under control of the configured VGA-type adapter, expanding the bits that represent the color of each pixel in the forwarded portion of the bit map into a color code stored in the bit mask register; and simultaneously writing color codes expanded from the forwarded portion of the bit map to the display memory to display the pixels on the video display.

4. The method of claim 1, wherein the VGA-type adapter has four display planes.

5. The method of claim 1, wherein the bit map specifies color of the pixels for opaque text.

6. A computer-readable medium having computer-executable instructions for performing the method of claim 1.

7. A method in a system having a video display, a central processing unit (CPU) and a VGA-type adapter with a bit mask register, a display memory divided into multiple planes and a latch for each plane, wherein the VGA-type adapter can display at least a total number of 256 different colors and wherein each color displayed by the VGA-type adapter is represented in the display memory by a color code comprising multiple bits, said VGA-type adapter having write modes that designate modes for writing data to the planes of the display memory, including write mode 2 in which all of the display planes can be written to, and said VGA-type adapter having modes for accessing the planes of the display memory including chain 4 mode wherein only a single one of the planes of display memory can be accessed at a time, said method comprising the steps of:

gathering a bit map for multiple pixels to be displayed on the video display, wherein the color displayed by each pixel is represented by 1 bit in the bit map, said bit map specifying whether each pixel is to assume a background color or a foreground color;

configuring the adapter by:

(i) placing the adapter in the write mode 2;

(ii) disabling the chain 4 mode;

(iii) enabling write access to all planes of the display memory;

loading the latches with a color code for the background color;

loading a result of an exclusive OR of the color code for the background color with color code for the foreground color into the bit mask register; and forwarding the gathered bit map to the VGA-type adapter so that color codes for the colors specified by the bit map for the pixels are written to the display memory to display the pixels on the video display.

8. The method of claim 7, wherein the VGA-type adapter is a Super VGA-type adapter, and wherein color codes comprise as least 16 bits.

9. The method of claim 7, wherein forwarding further comprises:

under CPU control, forwarding a portion of the bit map representing colors for at least two pixels;

under control of the configured VGA-type adapter, expanding the bits that represent the color of each pixel in the forwarded portion of the bit map into a color code stored in the bit mask register; and simultaneously writing color codes expanded from the forwarded portion of the bit map to the display memory to display the pixels on the video display.

10. The method of claim 7, further comprising storing the gathered bitmap in a system buffer prior to forwarding the gathered bitmap to the VGA-type adapter.

11. The method of claim 7, wherein the bit map specifies colors for up to eight pixels.

12. The method of claim 7, further comprising the step of configuring the VGA-type adapter to store 8-bit color codes for pixels.

13. The method of claim 12, wherein the VGA-type adapter has four display planes.

14. The method of claim 7, wherein the bit map specifies color of the pixels for opaque text.

15. A computer-readable medium having computer-executable instructions for performing the method of claim 7.

* * * * *

UNITED STATES PATENT AND TRADEMARK OFFICE

CERTIFICATE OF CORRECTION

PATENT NO. : 5,818,465
DATED : October 6, 1998
INVENTOR(S) : M. Abrash

It is certified that error appears in the above-identified patent and that said Letters Patent is hereby corrected as shown below:

| | | |
|---|---|---|
| 3 | 19 | after "display plane" insert --2-- |
| 6 (Claim 1, | 66 line 19) | after "map" (first occurrence) insert --,-- |

Signed and Sealed this

Twenty-third Day of February, 1999

*Attest:*

Q. TODD DICKINSON

*Attesting Officer*

*Acting Commissioner of Patents and Trademarks*